US010652653B2

(12) United States Patent
Chen et al.

(10) Patent No.: US 10,652,653 B2
(45) Date of Patent: May 12, 2020

(54) AUDIO PICKUP AND PLAY CIRCUIT AND SYSTEM, AND METHOD FOR SWITCHING AUDIO PICKUP AND PLAY

(71) Applicant: BOE Technology Group Co., Ltd., Beijing (CN)

(72) Inventors: Shuo Chen, Beijing (CN); Hao Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/240,093

(22) Filed: Jan. 4, 2019

(65) Prior Publication Data

US 2019/0327555 A1 Oct. 24, 2019

(30) Foreign Application Priority Data

Apr. 24, 2018 (CN) ..... 2018 1 0371150

(51) Int. Cl.
*H04R 3/00* (2006.01)
*H04R 1/08* (2006.01)

(52) U.S. Cl.
CPC ..... *H04R 3/00* (2013.01); *H04R 1/08* (2013.01); *H04R 2420/01* (2013.01); *H04R 2420/07* (2013.01)

(58) Field of Classification Search
CPC . H04R 3/00; H04R 1/08; H04R 1/222; H04R 1/245; H04R 1/326; H04R 2420/01; H04R 2420/03; H04R 2420/07
(Continued)

(56) References Cited

U.S. PATENT DOCUMENTS 5,692,057 A * 11/1997 Grad ..... H04R 3/00 381/122
8,750,528 B2 * 6/2014 Dong ..... H04R 3/00 381/123

(Continued)

FOREIGN PATENT DOCUMENTS

CN 101252609 A 8/2008
CN 201509258 U 6/2010

(Continued)

OTHER PUBLICATIONS

First Office Action and English language translation, CN Application No. 201810371150.1, dated Jan. 21, 2020, 20 pp.

*Primary Examiner* — Xu Mei
(74) *Attorney, Agent, or Firm* — Myers Bigel, P.A.

(57) ABSTRACT

The present disclosure relates to a circuit and system for audio pickup and play, and a method for switching audio pickup and play. The circuit includes a microphone array for collecting a first audio signal, a first wireless audio transceiver for receiving a second audio signal from a remote wireless microphone, an audio processor, a first audio player, a controller for outputting a first control signal and a second control signal, an audio input switcher for inputting the first audio signal or the second audio signal into the audio processor based on the first control signal. The audio processor is configured for processing the received first audio signal and second audio signal and outputting an audio play signal. The circuit includes an audio output switcher for outputting the audio play signal to the first audio player or the first wireless audio transceiver based on the second control signal.

20 Claims, 2 Drawing Sheets

(58) Field of Classification Search
USPC ..... 381/26, 91, 92, 122, 123, 80, 81
See application file for complete search history.

(56) References Cited

U.S. PATENT DOCUMENTS

| | | | | |
|---|---|---|---|---|
| 8,923,524 | B2 * | 12/2014 | Wise | H04R 1/1041 381/122 |
| 9,002,036 | B2 * | 4/2015 | Harney | H04R 1/245 381/122 |
| 9,628,207 | B2 * | 4/2017 | Emani | H04R 3/00 |
| 9,658,818 | B2 * | 5/2017 | Pelland | G06F 3/162 |
| 2007/0217632 | A1 * | 9/2007 | Wu | H04R 3/00 381/123 |
| 2009/0257602 | A1 * | 10/2009 | Darby | H04B 1/034 381/86 |
| 2010/0195836 | A1 * | 8/2010 | Platz | G09B 21/006 381/26 |
| 2015/0213797 | A1 | 7/2015 | Wang et al. | |

FOREIGN PATENT DOCUMENTS

| | | | |
|---|---|---|---|
| CN | 102820032 | A | 12/2012 |
| CN | 203136139 | U | 8/2013 |
| CN | 106161726 | A | 11/2016 |
| CN | 106385609 | A | 2/2017 |
| CN | 106775565 | A | 5/2017 |
| CN | 206946433 | U | 1/2018 |
| JP | 2016-9950 | A | 1/2016 |

* cited by examiner

AUDIO PICKUP AND PLAY CIRCUIT AND SYSTEM, AND METHOD FOR SWITCHING AUDIO PICKUP AND PLAY

CROSS REFERENCE TO RELATED APPLICATION(S)

This U.S. non-provisional patent application claims priority under 35 U.S.C. § 119 to Chinese patent application No. 201810371150.1 filed on Apr. 24, 2018, the entire disclosure of which is incorporated herein by reference.

TECHNICAL FIELD

The present disclosure relates to the field of audio switching technologies, and specifically to an audio pickup and play circuit and system, and a method for switching audio pickup and play.

BACKGROUND

What is currently adopted in voice interaction techniques is a remote audio pickup scheme that is implemented via a microphone array. Specifically, this function can be employed by a user in a very quiet environment ranging from 3 to 5 meters. The microphone array can collect a voice signal of the user and transmit it into a processor for processing, outputting and playing. However, when the user is far from the microphone array or the ambient environment is noisy, the voice signal collected by the microphone array will drop considerably in quality, which will affect the quality of voice output and reduce the user experience.

SUMMARY

According to one aspect of the present disclosure, an audio pickup and play circuit is provided. The audio pickup and play circuit comprises: a microphone array for collecting a first audio signal; a first wireless audio transceiver for receiving a second audio signal from a remote wireless microphone; an audio processor; a first audio player; a controller for outputting a first control signal and a second control signal; an audio input switcher for inputting the first audio signal or the second audio signal into the audio processor based on the first control signal, the audio processor being configured for processing the received first audio signal and second audio signal and outputting an audio play signal; and an audio output switcher for outputting the audio play signal to the first audio player or the first wireless audio transceiver based on the second control signal.

According to a specific embodiment of the present disclosure, in the audio pickup and play circuit described above, the controller further outputs the first control signal and the second control signal in response to a distance from the wireless microphone to the audio pickup and play circuit.

According to a specific embodiment of the present disclosure, in the audio pickup and play circuit described above, the controller further outputs the first control signal and the second control signal in response to the distance being smaller than a distance threshold, such that the audio input switcher inputs the first audio signal into the audio processor based on the first control signal, and the audio output switcher outputs the audio play signal to the first audio player based on the second control signal; and the controller further outputs the first control signal and the second control signal in response to the distance being greater than the distance threshold, such that the audio input switcher inputs the second audio signal into the audio processor based on the first control signal, and the audio output switcher outputs the audio play signal to the first wireless audio transceiver based on the second control signal.

According to a specific embodiment of the present disclosure, in the audio pickup and play circuit described above, the controller further outputs the first control signal and the second control signal in response to a volume of the first audio signal.

According to a specific embodiment of the present disclosure, in the audio pickup and play circuit described above, the controller further outputs the first control signal and the second control signal in response to the volume being greater than a volume threshold, such that the audio input switcher inputs the first audio signal into the audio processor based on the first control signal, and the audio output switcher outputs the audio play signal to the first audio player based on the second control signal; and the controller further outputs the first control signal and the second control signal in response to the volume being smaller than the volume threshold, such that the audio input switcher inputs the second audio signal into the audio processor based on the first control signal, and the audio output switcher outputs the audio play signal to the first wireless audio transceiver based on the second control signal.

According to a specific embodiment of the present disclosure, in the audio pickup and play circuit described above, the controller further outputs a third control signal in response to a distance from the wireless microphone to the audio pickup and play circuit, such that the microphone array and the wireless microphone are switched on or off based on the third control signal.

According to a specific embodiment of the present disclosure, in the audio pickup and play circuit described above, the controller further outputs a third control signal in response to a volume of the first audio signal, such that the microphone array and the wireless microphone are switched on or off based on the third control signal.

According to a specific embodiment of the present disclosure, in the audio pickup and play circuit described above, the microphone array comprises a plurality of microphones arranged in a linear or ring way.

According to another aspect of the present disclosure, an audio pickup and play system is further provided. The audio pickup and play system comprises: the audio pickup and play circuit described in any of the above embodiments; the wireless microphone for collecting the second audio signal; a second wireless audio transceiver for transmitting the second audio signal to the first wireless audio transceiver and receiving the audio play signal from the first wireless audio transceiver; and a second audio player for receiving and playing the audio play signal from the second wireless audio transceiver.

According to a specific embodiment of the present disclosure, in the audio pickup and play system described above, the wireless microphone comprises an audio collector.

According to a specific embodiment of the present disclosure, in the audio pickup and play system described above, the audio pickup and play system further comprises a distance sensor, the distance sensor being configured for measuring and outputting to the controller a distance from the wireless microphone to the audio pickup and play circuit.

According to a specific embodiment of the present disclosure, in the audio pickup and play system described above, the audio pickup and play system further comprises an image collector, the image collector being configured for acquiring a distance from the wireless microphone to the audio pickup and play circuit by collecting an image of the audio pickup and play system and outputting the distance to the controller.

According to a specific embodiment of the present disclosure, in the audio pickup and play system described above, the audio pickup and play system further comprises a volume detector, the volume detector being configured for detecting and outputting to the controller a volume of the first audio signal.

According to yet another aspect of the present disclosure, a method for switching audio pickup and play using the above audio pickup and play system is further provided. The method comprises: collecting by the microphone array the first audio signal; receiving by the first wireless audio transceiver the second audio signal from the wireless microphone; inputting by the audio input switcher the first audio signal or the second audio signal into the audio processor based on the first control signal outputted from the controller; and outputting by the audio output switcher the audio play signal to the first audio player or the first wireless audio transceiver based on the second control signal outputted from the controller.

According to a specific embodiment of the present disclosure, the method for switching audio pickup and play as described above further comprises: outputting by the controller the first control signal and the second control signal in response to a distance from the wireless microphone to the audio pickup and play circuit.

According to a specific embodiment of the present disclosure, the method for switching audio pickup and play as described above further comprises: outputting by the controller the first control signal and the second control signal in response to the distance being smaller than a distance threshold, such that the audio input switcher inputs the first audio signal into the audio processor based on the first control signal, and the audio output switcher outputs the audio play signal to the first audio player based on the second control signal; and outputting by the controller the first control signal and the second control signal in response to the distance being greater than the distance threshold, such that the audio input switcher inputs the second audio signal into the audio processor based on the first control signal, and the audio output switcher outputs the audio play signal to the first wireless audio transceiver based on the second control signal.

According to a specific embodiment of the present disclosure, the method for switching audio pickup and play as described above further comprises: outputting by the controller the first control signal and the second control signal in response to a volume of the first audio signal.

According to a specific embodiment of the present disclosure, the method for switching audio pickup and play as described above further comprises: outputting by the controller the first control signal and the second control signal in response to the volume being greater than a volume threshold, such that the audio input switcher inputs the first audio signal into the audio processor based on the first control signal, and the audio output switcher outputs the audio play signal to the first audio player based on the second control signal; and outputting by the controller the first control signal and the second control signal in response to the volume being smaller than the volume threshold, such that the audio input switcher inputs the second audio signal into the audio processor based on the first control signal, and the audio output switcher outputs the audio play signal to the first wireless audio transceiver based on the second control signal.

According to a specific embodiment of the present disclosure, the method for switching audio pickup and play as described above further comprises: outputting by the controller a third control signal in response to a distance from the wireless microphone to the audio pickup and play circuit, such that the microphone array and the wireless microphone are switched on or off based on the third control signal.

According to a specific embodiment of the present disclosure, the method for switching audio pickup and play as described above further comprises: outputting by the controller a third control signal in response to a volume of the first audio signal, such that the microphone array and the wireless microphone are switched on or off based on the third control signal.

BRIEF DESCRIPTION OF DRAWINGS

Specific embodiments of the present disclosure will be further described in detail with reference to the drawings.

DETAILED DESCRIPTION

Figure 1:
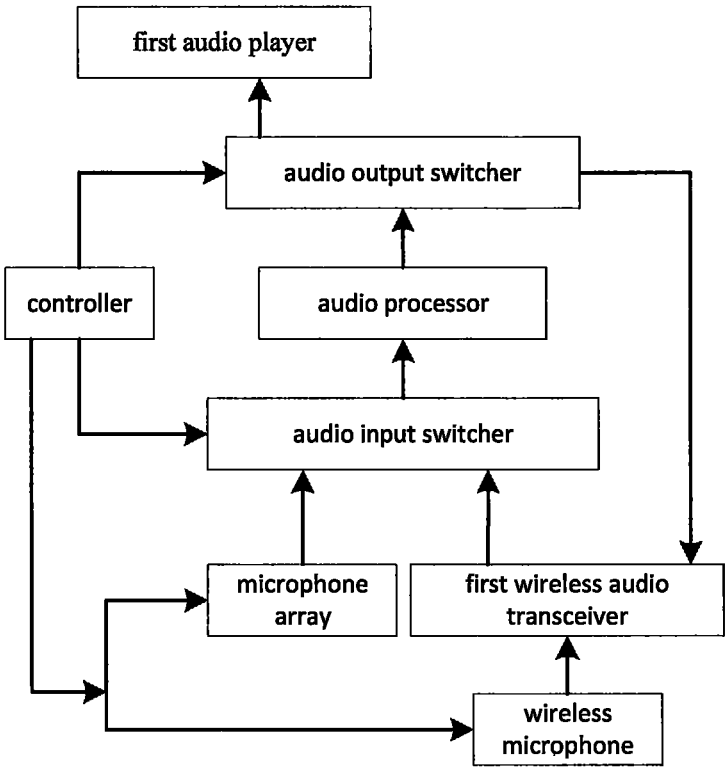
FIG. 1 shows a schematic structure view of the audio pickup and play circuit according to an embodiment of the present disclosure.

In order to render the present disclosure clearer, the present disclosure will be further explained with reference to the embodiments and the drawings. Similar components are indicated by same reference signs in the drawings. Those skilled in the art should understand that the contents specifically described below are explanatory rather than restrictive, and should not be regarded as limiting the protection scope of the present disclosure.

As shown in FIG. 1, an audio pickup and play circuit according to an embodiment of the present disclosure is shown. Specifically, the audio pickup and play circuit comprises a microphone array, a first wireless audio transceiver, an audio processor, a first audio player, a controller, an audio input switcher and an audio output switcher.

Figure 2:
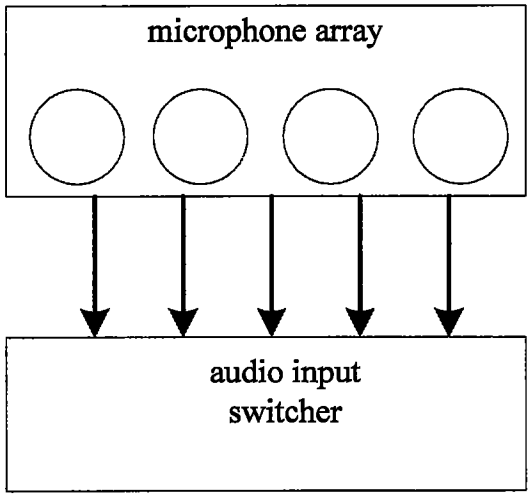
FIG. 2 shows a schematic structure view of the microphone array according to an embodiment of the present disclosure.

The microphone array is mainly used for collecting and outputting a first audio signal. In an embodiment as shown in FIG. 2, in order to improve the quality of audio signal collected by the microphone array, the microphone array can consist of a plurality of microphones which can be arranged in a linear or ring way.

The first wireless audio transceiver is used for receiving and outputting a second audio signal from a remote wireless microphone, and moreover it can receive and output an audio play signal from the audio processor. In some optional embodiments, the first wireless audio transceiver can be Bluetooth or wireless WIFI.

The audio processor is used for processing the first audio signal and the second audio signal and outputting the audio play signal. As an example, the processing can comprise sound source locating, noise reduction, echo cancellation and so on. In other words, by processing the first audio signal and the second audio signal inputted into the audio processor, the clarity of speech recognition can be improved and the user experience can be enhanced. In some optional embodiments, the first audio signal or the second audio signal can be a voice uttered by the user, for example, a question, and the audio play signal outputted from the audio processor can be another voice corresponding to the voice uttered by the user, for example, a response to the user's question.

The first audio player is used for receiving and playing an audio play signal. In other words, the audio play signal outputted by the audio processor after it processes the first audio signal or the second audio signal can be played by the first audio player. In an optional embodiment of the present disclosure, the first audio player can be a computer, a robot or other local players.

The audio input switcher is used for outputting the first audio signal from the microphone array or the second audio signal from the first wireless audio transceiver into the audio processor. In an optional embodiment, the audio input switcher can be a trigger. According to some embodiments, at one same time, only one of the first audio signal and the second audio signal is inputted into the audio processor.

The audio output switcher is used for outputting the audio play signal outputted from the audio processor to the first audio player for playing, or to the first wireless audio transceiver for forwarding for instance. In an optional embodiment, the audio output switcher can be a trigger. According to some embodiments, at one same time, the audio player signal is only transmitted to one of the first wireless audio transceiver and the first audio player.

The controller is used for transmitting a first control signal to the audio input switcher and a second control signal to the audio output switcher. In other words, the controller can transmit the first control signal to the audio input switcher, such that the audio input switcher can input the first audio signal or the second audio signal into the audio processor based on the first control signal. Correspondingly, the controller can also transmit the second control signal to the audio output switcher, such that the audio output switcher can output based on the second control signal the audio play signal to the first audio player for playing, or to the first wireless audio transceiver for forwarding for instance.

In some embodiments of the present disclosure, the controller outputs the first control signal and the second control signal in response to a distance from the wireless microphone to the audio pickup and play circuit. Specifically, the controller outputs the first control signal and the second control signal in response to the distance being smaller than a distance threshold, such that the audio input switcher inputs the first audio signal into the audio processor based on the first control signal, and the audio output switcher outputs the audio play signal to the first audio player based on the second control signal. Furthermore, the controller further outputs the first control signal and the second control signal in response to the distance being greater than the distance threshold, such that the audio input switcher inputs the second audio signal into the audio processor based on the first control signal, and the audio output switcher outputs the audio play signal to the first wireless audio transceiver based on the second control signal. When the user is far from the microphone array, it is difficult for the microphone array to pick up clear sounds and it is also difficult for the user to hear clearly the voice played. According to an embodiment of the present disclosure, the controller can be configured to choose, based on a distance from the wireless microphone (which is worn by the user for example) to the audio pickup and play circuit, whether to pick up sounds from the microphone array or from the wireless microphone, and how the audio signals are played. In this way, clear sounds can be picked up such that the user can hear them more clearly.

In some embodiments of the present disclosure, the controller outputs the first control signal and the second control signal in response to a volume of the first audio signal collected by the microphone array. Specifically, the controller outputs the first control signal and the second control signal in response to the volume being greater than a volume threshold, such that the audio input switcher inputs the first audio signal into the audio processor based on the first control signal, and the audio output switcher outputs the audio play signal to the first audio player based on the second control signal. Furthermore, the controller further outputs the first control signal and the second control signal in response to the volume being smaller than the volume threshold, such that the audio input switcher inputs the second audio signal into the audio processor based on the first control signal, and the audio output switcher outputs the audio play signal to the first wireless audio transceiver based on the second control signal. When the ambient environment is noisy, it is difficult for the microphone array to pick up clear sounds and it is also difficult for the user to hear clearly the sounds played. In an embodiment of the present disclosure, the controller can be configured to choose, based on a volume of the first audio signal collected, whether to pick up sounds from the microphone array or from the wireless microphone, and how the audio signals are played. In this way, clear sounds can be picked up such that the user can hear them more clearly.

In a specific embodiment of the present disclosure, the operation of audio pickup and play circuit is mainly divided into two processes: audio pickup and play (i.e., audio play).

When the user uses the audio pickup and play circuit to pick up sounds, the user can output audio signals to the microphone array and the wireless microphone by speaking or by other means. After that, the microphone array will output a first audio signal; and likewise, the wireless microphone will output a second audio signal. In this case, the audio input switcher will output the first audio signal or the second audio signal into the audio processor for processing.

Usually, the wireless microphone is worn by the user, and the microphone array is relatively far away from the user. Therefore, when the user is far away from the microphone array, it is possible that the audio pickup effect of the microphone array cannot meet requirements of the user due to the far distance. To this end, the user needs to switch the audio pickup process to the wireless microphone which is closer to the user than the microphone array. In this case, the user may determine whether the audio pickup effect of the microphone array meets the requirements of the user by presetting a suitable distance threshold in use. When the distance from the microphone array to the user (who wears the wireless microphone for example) is greater than the distance threshold preset by the user, it is determined that the audio pickup effect of the microphone array cannot meet the requirements of the user. In such an embodiment, the controller can transmit the first control signal to the audio input switcher, such that the second audio signal outputted from the wireless microphone is inputted into the audio processor for processing.

When the distance from the microphone array to the user (who wears the wireless microphone for example) is smaller than or equal to the distance threshold preset by the user, it is determined that the audio pickup effect of the microphone array has met the requirements of the user. In this case, the controller can transmit the first control signal to the audio input switcher, such that the first audio signal outputted from the microphone array is inputted into the audio processor for processing. Thus, during the audio pickup process, the user can selectively input and control the first audio signal or the second audio signal, which enhances the audio pickup effect. Thereby, after further processing, the resulted audio play signal will be outputted to the first audio player or the first wireless audio transceiver via the audio output switcher.

Similarly, during the play process of the audio pickup and play circuit, when the distance from the first audio layer to the user is greater than a distance threshold preset by the user, the user may not hear clearly the content played by the first audio player due to the far distance, which will reduce the user experience. To this end, in an embodiment of the present disclosure, the controller can output the second control signal to the audio output switcher based on a distance between the user (who wears the wireless microphone for example) and the audio pickup and play circuit. Now, when the distance from the microphone array to the user (who wears the wireless microphone for example) is greater than the distance threshold preset by the user, it is determined that the play effect of the first audio player cannot meet the requirements of the user. In this case, the first controller can transmit the second control signal to the audio output switcher, such that the audio play signal can be outputted to the first wireless audio transceiver. Thereby, the first wireless audio transceiver can transmit the audio play signal to a play end for playing, which play end is nearer to the user than the first audio player.

When the distance from the microphone array to the user (who wears the wireless microphone for example) is smaller than or equal to the distance threshold preset by the user, it is determined that the play effect of the first audio player has met the requirements of the user. Now, the first controller can transmit the second control signal to the audio output switcher, such that the audio play signal can be outputted to the first audio player for playing. In this way, directional transmission of the audio player signal can be controlled during play, which improves the user experience and the success rate of user speech recognition.

From the foregoing, during the audio pickup process of the audio pickup and play circuit according to an embodiment of the present disclosure, the microphone array and the wireless microphone will perform the audio pickup operation simultaneously, and the audio input switcher will input the first audio signal or the second audio signal into the audio processor. As a result, electrical energy will be wasted due to the concurrent operation of the microphone array and the wireless microphone, which leads to unnecessary loss. To this end, in an advantageous embodiment of the present disclosure, the controller can further output a third control signal based on a distance from the user (who wears the wireless microphone for example) to the audio pickup and play circuit, wherein the third control signal can control the microphone array and the wireless microphone to be switched on or off.

Specifically, when the distance from the wireless microphone worn by the user to the audio pickup and play circuit is greater than a distance threshold preset by the user, the controller will output a third control signal, so as to control the operation of the remote microphone. On the contrary, when the distance from the wireless microphone worn by the user to the audio pickup and play circuit is smaller than or equal to the distance threshold preset by the user, the controller will output a third control signal, so as to control the operation of the microphone array. Thus, only one of the wireless microphone and the microphone array can perform the collection operation, which avoids the concurrent operation of the wireless microphone and the microphone array, and finally reduces energy consumption.

In some embodiments of the present disclosure, the controller can further output a third control signal based on a volume of the audio signal collected by the microphone array, wherein the third control signal can control the microphone array and the wireless microphone to be switched on or off.

Specifically, when the volume of the audio signal collected by the microphone array is smaller than a certain volume threshold, the controller will output a third control signal so as to control the wireless microphone to operate. On the contrary, when the volume of the audio signal collected by the microphone array is greater than a certain volume threshold, the controller will output a third control signal so as to control the microphone array to operate. Thus, only one of the wireless microphone and the microphone array can perform the collection operation, which avoids the concurrent operation of the wireless microphone and the microphone array, and finally reduces energy consumption.

Figure 3:
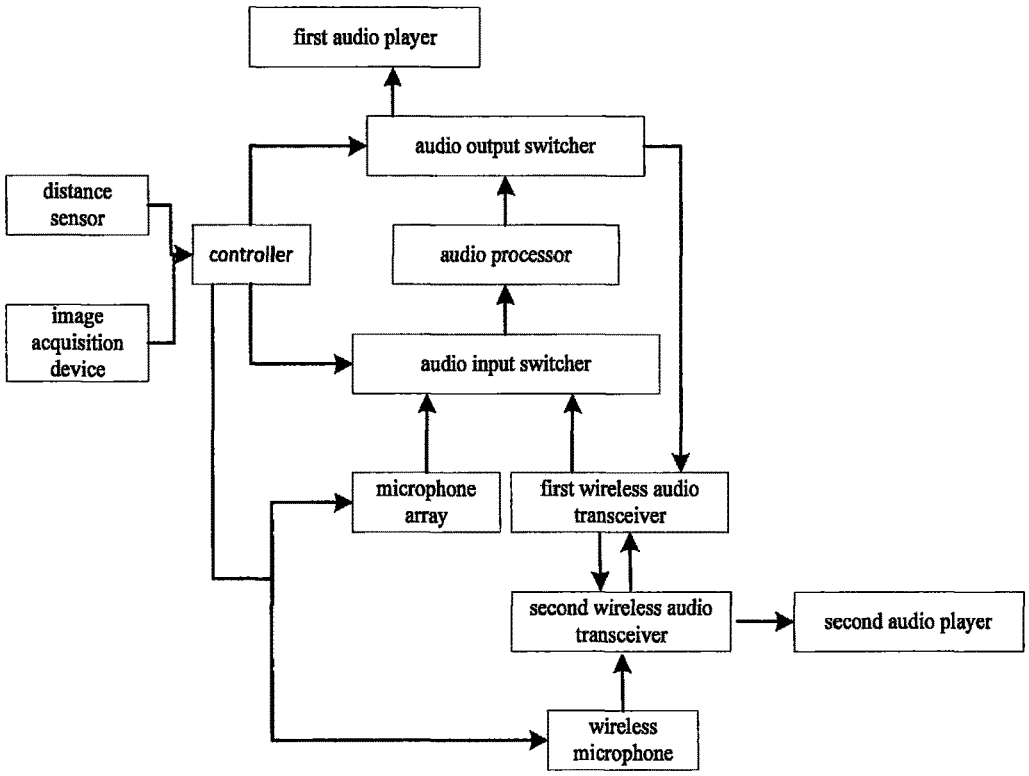
FIG. 3 shows a schematic structure view of the audio pickup and play system according to an embodiment of the present disclosure.

Next, according to an embodiment as shown in FIG. 3, the present disclosure further proposes an audio pickup and play system based on the above audio pickup and play circuit. Specifically, the audio pickup and play system can comprise the above audio pickup and play circuit, the wireless microphone, a second audio player and a second wireless audio transceiver.

In some embodiments of the present disclosure, the wireless microphone comprises an audio collector, wherein the audio collector is mainly used for collecting and outputting an audio signal.

The second wireless audio transceiver is mainly used for transmitting the audio signal collected by the audio collector to the first wireless audio transceiver. Next, upon receipt of the audio signal, the first wireless audio transceiver will output it to the audio input switcher. Besides, the first wireless audio transceiver is further capable of receiving the audio play signal outputted from the audio processor and forwarding it to the second wireless audio transceiver.

The second audio player is mainly used for outputting the audio play signal received from the second wireless audio transceiver. In other words, the wireless microphone can transmit the collected audio signal to the first wireless audio transceiver, and the first audio transceiver can output the audio signal to the audio input switcher. Thereby, the audio input switcher can continue to input the audio signal into the audio processor for processing. After processing, the audio processor will output the audio play signal, and the audio output switcher can output the audio play signal to the first wireless audio transceiver, such that the second wireless audio transceiver can receive the audio play signal from the first wireless audio transceiver and output it to the second audio player for play.

The second wireless audio transceiver can be Bluetooth or wireless WIFI.

In some optional embodiments, the wireless microphone and the second audio player can be integrated. For example, they can be integrated as a wireless earphone, a mobile phone or the like having an audio pickup function.

In a specific embodiment of the present disclosure, the audio pickup and play system further comprises a distance sensor, an image acquisition device, or other suitable means for collecting distance. As an example, the image acquisition device can be a processor carrying a camera or other image acquisition means. Moreover, the distance sensor can detect a distance between the wireless microphone and the audio pickup and play circuit, and output the distance to the controller. Typically, when the user uses the wireless microphone, he/she will usually wear it on his/her body. Therefore, the image acquisition device can acquire a distance between the user and the audio pickup and play circuit by taking images of the user and the ambiance thereof, thereby obtaining a distance between the wireless microphone and the audio pickup and play circuit, and outputting the distance to the controller. Next, upon receipt of the distance, the controller can output the first control signal and the second control signal to the corresponding audio input switcher and audio output switcher respectively based on the distance. As an example, a binocular distance-measuring method can be adopted in determining a distance by means of images acquired by the image acquisition device for instance.

As mentioned above, when the user uses the wireless microphone, he/she will usually wear it on his/her body. Therefore, during the audio pickup process, a distance sensor or an image acquisition device can be used to detect a distance from the wireless microphone to the microphone array in the audio pickup and play circuit, and output the distance to the control unit. After that, the control unit can determine based on the distance whether the user is located within a distance threshold having a good audio pickup effect, and control the audio input switcher to switch between the first audio signal and the second audio signal by transmitting the first control signal. In such an embodiment, the distance threshold can be preset in a user-defined manner upon actual situations. By the same token, during the play process of the audio pickup and play circuit, a distance sensor or an image acquisition device can be used to detect a distance from the wireless microphone to the first audio player in the audio pickup and play circuit, and output the distance to the control unit. Thereby, the control unit can determine based on the distance whether the user is located within a distance threshold having a good audio pickup effect. Likewise, the distance threshold can be preset in a user-defined manner upon actual situations. After that, by transmitting the second control signal, the audio output switcher can be controlled to output the audio play signal to the first audio player or the first wireless audio transceiver.

In some optionally embodiments, the audio pickup and play system can further comprise a volume detector for measuring a volume of the audio signal collected by the microphone array and outputting the volume to the controller. Specifically, the controller can output the first control signal and the second control signal in response to the volume being greater than a volume threshold, such that the audio input switcher inputs the first audio signal into the audio processor based on the first control signal, and the audio output switcher outputs the audio play signal to the first audio player based on the second control signal. Similarly, the controller can output the first control signal and the second control signal in response to the volume being smaller than the volume threshold, such that the audio input switcher inputs the second audio signal into the audio processor based on the first control signal, and the audio output switcher outputs the audio play signal to the first wireless audio transceiver based on the second control signal. When the ambient environment is noisy, it is difficult for the microphone array to pick up clear sounds and it is also difficult for the user to hear clearly the voice played. According to an embodiment of the present disclosure, the controller can be configured to choose, based on a volume of the sounds collected, whether to pick up sounds from the microphone array or from the wireless microphone, and how the audio signals are played. In this way, clear sounds can be picked up such that the user can hear them more clearly.

In an optional embodiment, the audio pickup and play system can further comprise a voice responder for receiving the audio play signal obtained after processing by the audio processor, and performing speech recognition on the signal, so as to give a response and transmit content of the response to the audio processor. Finally, the audio processor generates an audio play signal for response. Furthermore, the audio output switcher can be controlled by means of the third control signal outputted from the controller, so as to input the audio play signal for response into the first audio player or the first wireless audio transceiver. As an example, the voice responder can be a computer, a robot or other terminals having functions of speech recognition and intelligent response.

In other words, during the audio pickup process, the user can output via the wireless microphone or the microphone array his/her own audio signal to the audio processor for processing. Moreover, the voice responder can recognize the processed audio play signal and give an intelligent response based on the recognized content. Besides, the voice responder can further transmit content of the response to the audio processor which generates an audio play signal for response. Finally, the user can listen to the content of the response via the first audio player or the second audio player. In this way, the user can interact with the voice responder.

Figure 4:
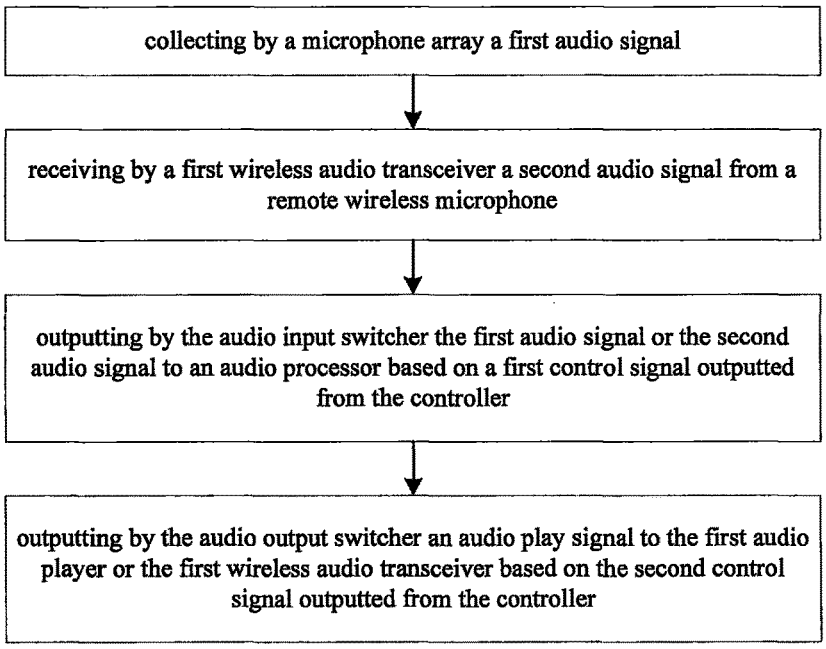
FIG. 4 shows a flow chart of the method for switching audio pickup and play according to an embodiment of the present disclosure.

Finally, a method for switching audio pickup and play using the audio pickup and play system according to an embodiment of the present disclosure will be explained with reference to FIG. 4. Specifically, the method comprises steps of: collecting and outputting by a microphone array a first audio signal; receiving by a first wireless audio transceiver a second audio signal from a remote wireless microphone; outputting by an audio input switcher the first audio signal or the second audio signal into an audio processor based on a first control signal outputted from a controller; and outputting by an audio output switcher an audio play signal to a first audio player or a first wireless audio transceiver based on a second control signal outputted from the controller.

When using the audio pickup and play system, the user can wear the wireless microphone on his/her body, and the specific operation can be mainly divided into two processes: audio pickup and play.

In some embodiments of the present disclosure, when the audio pickup operation is performed, audio signals can be collected from both an audio pickup remote end and an audio pickup near end. As an example, the audio pickup remote end can be the microphone array in the embodiments of the present disclosure, and the audio pickup near end can be the wireless microphone. Specifically, the microphone array can collect and output a first audio signal, and the wireless microphone can collect a second audio signal and transmit the second audio signal to the first audio transceiver via the second wireless audio transceiver. After that, the controller can output a first control signal based on the distance between the wireless microphone and the microphone array in the audio pickup and play circuit. The first control signal can control the audio input switcher, and the audio input switcher can input the first audio signal or the second audio signal into the audio processor for processing, based on the first control signal, and finally output an audio play signal.

In some embodiments of the present disclosure, when the audio play operation is performed, the audio play signal can be outputted from an audio play remote end and an audio play near end. As an example, the audio play remote end can be the first audio player in the embodiments of the present disclosure, and the audio play near end can be the second audio player. During the audio play operation, the controller can output a second control signal based on the distance between the wireless microphone and the first audio player in the audio pickup and play circuit. The second control signal can control the audio output switcher, and the audio output switcher can output based on the second control signal the audio play signal into the first audio player, or into the first wireless audio transceiver, so as to finally play it via the second audio player. By means of the processes of audio pickup and audio play, the user can choose audio pickup and play at either a remote end or a near end upon his/her own needs, which can improve the user experience and the success rate of speech recognition.

Apparently, the above embodiments of the present disclosure are only provided as examples for clearly explaining the present disclosure, rather than limitations to the implementations of the present disclosure. For a person having ordinary skills in the art, variations or modifications in other different forms can also be made based on the above explanations, and it is impossible to exhaust all implementations herein. Obvious modifications or variations derived from the technical solution of the present disclosure will all fall within the protection scope of the present disclosure.

What is claimed is:

1. An audio pickup and play circuit, comprising:

a microphone array configured to collect a first audio signal;

a first wireless audio transceiver configured to receive a second audio signal from a wireless microphone that is remote to the first wireless audio transceiver;

an audio processor;

a first audio player;

a controller configured to output a first control signal and a second control signal;

an audio input switcher configured to input the first audio signal or the second audio signal into the audio processor based on the first control signal, wherein the audio processor is configured to process the first audio signal and the second audio signal that are received and configured to output an audio play signal; and an audio output switcher configured to output the audio play signal to the first audio player or the first wireless audio transceiver based on the second control signal.

2. The audio pickup and play circuit according to claim 1, wherein the controller is further configured to output the first control signal and the second control signal based on a distance from the wireless microphone to the audio pickup and play circuit.

3. The audio pickup and play circuit according to claim 2, wherein the controller is further configured to output the first control signal and the second control signal in response to the distance being less than a distance threshold, such that the audio input switcher inputs the first audio signal into the audio processor based on the first control signal, and the audio output switcher outputs the audio play signal to the first audio player based on the second control signal, wherein the controller is further configured to output the first control signal and the second control signal in response to the distance being greater than the distance threshold, such that the audio input switcher inputs the second audio signal into the audio processor based on the first control signal, and the audio output switcher outputs the audio play signal to the first wireless audio transceiver based on the second control signal.

4. The audio pickup and play circuit according to claim 1, wherein the controller is further configured to output the first control signal and the second control signal in response to a volume of the first audio signal.

5. The audio pickup and play circuit according to claim 4, wherein the controller is further configured to output the first control signal and the second control signal in response to the volume being greater than a volume threshold, such that the audio input switcher inputs the first audio signal into the audio processor based on the first control signal, and the audio output switcher outputs the audio play signal to the first audio player based on the second control signal, and wherein the controller is further configured to output the first control signal and the second control signal in response to the volume being less than the volume threshold, such that the audio input switcher inputs the second audio signal into the audio processor based on the first control signal, and the audio output switcher outputs the audio play signal to the first wireless audio transceiver based on the second control signal.

6. The audio pickup and play circuit according to claim 1, wherein the controller is further configured to output a third control signal based on a distance from the wireless microphone to the audio pickup and play circuit, such that the microphone array and the wireless microphone are switched on or off based on the third control signal.

7. The audio pickup and play circuit according to claim 1, wherein the controller is further configured to output a third control signal based on a volume of the first audio signal, such that the microphone array and the wireless microphone are switched on or off based on the third control signal.

8. The audio pickup and play circuit according to claim 1, wherein the microphone array comprises a plurality of microphones arranged in a linear pattern or a ring pattern.

9. An audio pickup and play system, comprising:

the audio pickup and play circuit according to claim 1;

the wireless microphone configured to collect the second audio signal;

a second wireless audio transceiver configured to transmit the second audio signal to the first wireless audio transceiver and configured to receive the audio play signal from the first wireless audio transceiver; and a second audio player configured to receive and play the audio play signal from the second wireless audio transceiver.

10. The audio pickup and play system according to claim 9, wherein the wireless microphone comprises an audio collector.

11. The audio pickup and play system according to claim 9, wherein the audio pickup and play system further comprises:

a distance sensor, wherein the distance sensor is configured to measure and output to the controller a distance from the wireless microphone to the audio pickup and play circuit.

12. The audio pickup and play system according to claim 9, wherein the audio pickup and play system further comprises:

an image collector, wherein the image collector is configured to acquire a distance from the wireless microphone to the audio pickup and play circuit by collecting an image of the audio pickup and play system and outputting the distance to the controller.

13. The audio pickup and play system according to claim 9, wherein the audio pickup and play system further comprises a volume detector, wherein the volume detector is configured to detect and output to the controller a volume of the first audio signal.

14. A method for switching audio pickup and play using the audio pickup and play system according to claim 9, comprising:

collecting by the microphone array the first audio signal;

receiving by the first wireless audio transceiver the second audio signal from the wireless microphone;

inputting by the audio input switcher the first audio signal or the second audio signal into the audio processor based on the first control signal outputted from the controller; and outputting by the audio output switcher the audio play signal to the first audio player or the first wireless audio transceiver based on the second control signal outputted from the controller.

15. The method according to claim 14, further comprising:

outputting by the controller the first control signal and the second control signal based on a distance from the wireless microphone to the audio pickup and play circuit.

16. The method according to claim 15, further comprising:

outputting by the controller the first control signal and the second control signal in response to the distance being less than a distance threshold, such that the audio input switcher inputs the first audio signal into the audio processor based on the first control signal, and the audio output switcher outputs the audio play signal to the first audio player based on the second control signal; and outputting by the controller the first control signal and the second control signal in response to the distance being greater than the distance threshold, such that the audio input switcher inputs the second audio signal into the audio processor based on the first control signal, and the audio output switcher outputs the audio play signal to the first wireless audio transceiver based on the second control signal.

17. The method according to claim 14, further comprising:

outputting by the controller the first control signal and the second control signal based on a volume of the first audio signal.

18. The method according to claim 17, further comprising:

outputting by the controller the first control signal and the second control signal in response to the volume being greater than a volume threshold, such that the audio input switcher inputs the first audio signal into the audio processor based on the first control signal, and the audio output switcher outputs the audio play signal to the first audio player based on the second control signal; and outputting by the controller the first control signal and the second control signal in response to the volume being less than the volume threshold, such that the audio input switcher inputs the second audio signal into the audio processor based on the first control signal, and the audio output switcher outputs the audio play signal to the first wireless audio transceiver based on the second control signal.

19. The method according to claim 14, further comprising:

outputting by the controller a third control signal based on a distance from the wireless microphone to the audio pickup and play circuit, such that the microphone array and the wireless microphone are switched on or off based on the third control signal.

20. The method according to claim 14, further comprising:

outputting by the controller a third control signal based on a volume of the first audio signal, such that the microphone array and the wireless microphone are switched on or off based on the third control signal.

* * * * *